United States Patent [19]

Hudson et al.

[11] Patent Number: 4,629,553

[45] Date of Patent: Dec. 16, 1986

[54] HYDROFINING PROCESS

[75] Inventors: Carl W. Hudson; Gerald E. Markley, both of Baton Rouge, La.

[73] Assignee: Exxon Research and Engineering Company, Florham Park, N.J.

[21] Appl. No.: 760,834

[22] Filed: Jul. 31, 1985

[51] Int. Cl.[4] ..... C10G 65/04

[52] U.S. Cl. ..... 208/212; 208/210; 208/217; 208/254 H

[58] Field of Search ..... 208/217, 254 H, 210, 208/211, 89, 244, 285, 255, 18, 212

[56] References Cited

U.S. PATENT DOCUMENTS

| | | | |
|---|---|---|---|
| 3,340,183 | 9/1967 | Egan | 208/212 |
| 3,382,168 | 5/1968 | Wood et al. | 208/211 |
| 3,457,163 | 7/1969 | Parker | 208/211 |
| 3,464,915 | 9/1969 | Paterson et al. | 208/211 |
| 3,549,520 | 12/1970 | Morris | 208/212 |
| 4,131,537 | 12/1978 | Winter et al. | 208/255 |

*Primary Examiner*—Andrew H. Metz

*Assistant Examiner*—Anthony McFarlane

*Attorney, Agent, or Firm*—Llewellyn A. Proctor

[57] ABSTRACT

A process wherein in a hydrofining zone, a sulfur- or nitrogen-containing distillate feed, or feed containing both sulfur and nitrogen, is hydrofined at hydrofining conditions sufficient to convert the sulfur and nitrogen to hydrogen sulfide, and ammonia, respectively, the hydrogen sulfide and ammonia are separated from the hydrofined product, and the hydrofined product contacted in a subsequent zone with hydrogen, or a hydrogen-containing gas over a catalyst which contains elemental iron and one or more alkali- or alkaline-earth metals at reaction conditions sufficient to reduce or restore the color of the hydrofined product. Operation in this manner permits hydrofining of the feed at higher severities, for longer periods, than heretofore possible because the adverse quality of the product reaction mixture normally caused by deterioration of the hydrofiner product at such conditions is remediated by treatment of the hydrofined product over the iron catalyst.

18 Claims, No Drawings

HYDROFINING PROCESS

RELATED APPLICATIONS

This application is related to Application Ser. No. 611,859, filed May 18, 1984, titled "Process for the Denitrogenation of Nitrogen-Containing Hydrocarbon Compounds" by Carl W. Hudson, now abandoned, and to Application Ser. No. 635,729, filed July 30, 1984, titled "Process for the Removal of Polynuclear Aromatic Hydrocarbon Compounds From Admixtures of Liquid Hydrocarbon Compounds" by Carl W. Hudson and Glen P. Hamner, now abandoned.

Other related applications are: Application Ser. No. 760,871 by Carl W. Hudson; Application Ser. No. 760,961 by Carl W. Hudson and Glen P. Hamner; Application Ser. No. 760,894, by Carl W. Hudson and Glen P. Hamner; Application Ser. No. 760,962, by Carl W. Hudson and Glen P. Hamner; and Application Ser. No. 760,,835, by Carl W. Hudson and Glen P. Hamner; filed of even date herewith.

BACKGROUND OF THE INVENTION

I. Field of the Invention

This invention relates to improvements in hydrofining processes. In particular, it relates to a process for improving the operability and extending the cycle length of a hydrofining unit.

II. Background and Prior Art

Hydrotreating is a well known and widely used type of refinery operation. It relates to the treatment of a variety of hydrocarbons with hydrogen in the presence of a catalyst. Such hydrocarbons are characterized generally as naphthas, solvents, distillate fuels and residual fuels. In the treatment of residual fuels the process is termed hydrodesulfurization since the primary object is to remove sulfur. In treating other than residual fuels, the process is generally termed "hydrofining," and the purpose of such operation is generally to improve odor, color, stability, combustion and other important quality characteristics. Hydrofining processes also produce aromatics saturation, and remove heteroatoms, e.g., sulfur and nitrogen, and other non-carbon components. Hydrofining, as used herein, relates to the treatment with hydrogen, in the presence of a catalyst, of distillates to produce heating oils and fuels.

In hydrofining, a refinery stream, e.g., a distillate, or gas oil, and hydrogen, are contacted over a catalyst at moderate to high temperatures and pressures. The hydrofining unit is constituted of one or a plurality of reactors, each provided with a fixed bed, or beds, of the catalyst. Each reactor of the series receives upflow or downflow feed, the feed being preheated in an interstage heater prior to its introduction into the reactor, or reactors. In a hydrofining operation, as the duration of the run progresses, the activity of the catalyst declines due to the buildup of coke on the catalyst. Consequently, as the run progresses, the temperature of the reactor, or reactors, is increased to compensate for the activity loss, and maintain an acceptable level of production. Eventually, as the operating severity of the run is increased, in treating gas oil feeds, the hydrofined product becomes discolored, and the discoloration increases to the point where the product is unacceptable. Poor product color is thus associated with decline in product quality, the level of which increases with increasing severity, i.e., increasing temperatures. Eventually it becomes necessary to terminate the run to regenerate the catalyst by burning off the coke in preparation for a new operating run.

Long run length is necessary for good economy. Nonetheless, from time-to-time it is necessary to shut down the unit to regenerate the catalyst. "Down time," i.e., the frequency at which a hydrofining unit is shut down for regeneration of the catalyst, is determined in part by the maximum temperature which can be tolerated during an operation. Obviously, steps taken to increase run length, or decrease down time, have a positive effect on the overall economics of the hydrofining process. The maximum allowable end-of-run temperature can be dictated by many factors such as the onset of hydrodenitrogenation-aromatics saturation equilibrium effects, furnace limitations or, as suggested, by product quality deterioration as higher temperatures are reached. Poor product color does, in fact, occur in some commercial hydrofining units operating at low pressure, e.g., at 300–550 pounds per square inch (psi) hydrogen, when operating temperatures are pushed beyond about 340° C. (644° F.). Such problem dictates the shut down of the hydrofiner for catalyst regeneration despite the fact that run length could be further extended by further temperature increases to promote hydrodenitrogenation and aromatics saturation.

III. Objects

It is, accordingly, the primary object of this invention to provide an improved distillate hydrofining process, particularly one for improving the operability and extending the cycle length of a distillate hydrofining unit.

A specific object is to provide a novel process wherein distillate stocks can be hydrofined at higher severities at increased run lengths.

IV. The Invention

These objects and others are achieved in accordance with this invention embodying a process wherein, in a hydrofining zone, a sulfur- or nitrogen-containing distillate feed, or feed containing both sulfur and nitrogen, is hydrofined (i.e., treated with hydrogen) at hydrofining conditions sufficient to convert the sulfur and nitrogen to hydrogen sulfide, and ammonia, respectively, the hydrogen sulfide and ammonia are separated from the hydrofined product, and the hydrofined product contacted in a subsequent zone with hydrogen, or a hydrogen-containing gas over a catalyst, which contains elemental iron and one or more of an alkali or alkaline-earth metal [i.e., a Group IA or IIA metal (Periodic Table of the Elements, E. H. Sargent & Co., Copyright 1964 Dyna-Slide Co.)] or compound thereof, and preferably additionally a Group IIIA metal, or metal compound, particularly aluminum, or compound thereof, at reaction conditions sufficient to restore (or reduce) the color of the hydrofined product. Operation in this manner permits hydrofining of the feed at higher severities, for longer periods, than heretofore possible because the adverse product quality of the reaction mixture, normally caused by severe hydrofiner conditions, can be remedied by treatment of the hydrofined product over the iron catalyst.

Feeds susceptible to treatment in accordance with this invention are characterized as distillates, or admixtures of hydrocarbons which contain organic sulfur, or organic nitrogen, or both, having a high end boiling point below about 370° C. (698° F.), preferably below about 340° C. (644° F.), and an initial boiling point above about 150° C. (302° F.), preferably above about 175° C. (347° F.). Generally such feeds contain as much as about 2 percent of sulfur, and higher, typically from about 0.5 to about 2 percent sulfur, based on the weight of the feed. Such feeds generally contain as much as about 2500 parts per million (ppm) of nitrogen, and higher, typically from about 10 ppm to about 500 ppm of nitrogen, based on the weight of the feed. Such feeds typically contain from about 3 percent to about 40 percent paraffins, from about 2 percent to about 10 percent olefins, and from about 50 percent to about 95 percent aromatics. Hydrofining such a feed can generally reduce the sulfur level to less than about 2000 ppm, or even 200 ppm, and the nitrogen level to less than about 300 ppm after removal of the hydrogen sulfide and ammonia from the hydrofined product.

In conducting the hydrofining portion of the process, the feed is contacted in a hydrofining zone, or zones, over a hydrofining catalyst at hydrofining conditions. Suitable hydrofining catalysts are composites of porous refractory inorganic oxides, such as alumina, and a Group VI-B or Group VIII metal, or both, of the Periodic Table of the Elements. Suitable carriers, or supports, are such inorganic oxides as alumina, silica, zirconia, titania, bauxite, magnesia, fuller's earth, and combinations thereof. The metal content of a catalyst preferably ranges between about 2 to 25 weight percent, based on the total weight of the catalyst. Suitable catalysts include cobalt-molybdate, chromic acid, nickel, iron, etc. which are deposited on carriers, such as alumina, or various other oxides, or gels. A suitable catalyst for the hydrofining portion of the process is, for example, an alumina-containing support with a minor proportion of molybdenum oxide and cobalt oxide. Sulfided nickel and tungsten on alumina as well as nickel-molybdenum on alumina can also be used.

The hydrofining step is conducted under conditions of temperature, pressure, hydrogen flow rate and liquid hourly space velocity, correlated to provide the desired degree of organic sulfur and organic nitrogen conversion. The hydrofining temperature generally ranges from about 275° C. (527° F.) to about 450° C. (842° F.), and preferably from about 325° C. (617° F.) to about 410° C. (770° F.). At temperatures below about 275° C. (527° F.), the rate of conversion of organic nitrogen and organic sulfur is too low for practical purposes whereas at temperatures above about 450° C. (842° F.) substantial cracking of the feed occurs. Also coke formation tends to increase markedly at the higher temperatures. The temperature used will also depend on the activity of the hydrofining catalyst, higher temperatures being used with less active catalysts. The pressure in the hydrofining zone will generally range from about 100 psig to about 1400 psig, and more preferably ranges from about 200 psig to about 1000 psig. Elevated pressures advantageously influence the rate and extent of hydrofining, as well as extend the catalyst activity and life. However, higher pressures increase the cost of the hydrofining operation. The liquid hourly space velocity in the reaction zone will generally range from about 0.1 to about 10, preferably from about 1 to about 5.

The flow of hydrogen into the hydrofining reactor, or reactors, is preferably maintained above about 200 SCF/Bbl (standard cubic feet/barrel) and more preferably within a range of from about 300 to about 2000 SCF/Bbl. More generally, at least sufficient hydrogen is provided to supply that consumed in the conversion of sulfur and nitrogen compounds to hydrogen sulfide and ammonia, respectively, and to produce the hydrogenation of unsaturated components, e.g., olefins, while generally maintaining a significant excess of hydrogen partial pressure. The hydrogen can be added to the feed prior to introduction of the feed into the hydrofining reactor, or reactors, or can be added to the hydrofining reactor, or reactors, separate from the feed. The hydrogen is passed through the reactor, or reactors, in contact with the catalyst on a once-through basis, or is recycled.

The effluent from the hydrofining zone is treated to remove hydrogen sulfide and ammonia from the hydrofined product. Removal of hydrogen sulfide and ammonia may be accomplished, for example, by injecting water or alkalized water into the hydrofiner effluent and passing the resulting mixture into a separator operating under such conditions that a water phase containing essentially all the hydrogen sulfide and ammonia present in the effluent can be removed. Further purification of the hydrofined feed can be accomplished by a stripper or a distillation column. Also, the hydrogen sulfide and ammonia can be removed by passing the hydrofiner effluent to a separator at a temperature and pressure whereby substantially only hydrogen sulfide, ammonia, and hydrogen are in the gaseous state. The liquid product is readily separated from the gases. It is essential to reduce the concentration of hydrogen sulfide in the liquid product.

The hydrogen sulfide and ammonia are readily separated from the hydrofined liquid product by these and various other available means known to the art. Suitably however, the hydrofined product is discharged as a liquid into a receiver, or separator at a temperature and pressure whereby the hydrogen sulfide, hydrogen, and some of the ammonia, are in a gaseous state. The hydrogen-containing stream can be introduced into a gas treating zone to separately recover hydrogen, hydrogen sulfide and ammonia; or it can be used as a fuel. The liquid product, which yet will contain some dissolved hydrogen sulfide and ammonia can then be distilled, fractionated, and stabilized to provide a product substantially free of hydrogen sulfide and ammonia for treatment over the iron catalyst.

The hydrofined distillate product, essentially free of hydrogen sulfide and ammonia, is then contacted with hydrogen, or hydrogen-containing gas, over the iron catalyst at reaction conditions sufficient to reduce the color, and desirably also the residual nitrogen concentration of the hydrofined feedstock. Suitably, the reaction is conducted at temperatures ranging from about 225° C. (437° F.) to about 430° C. (806° F.), preferably from about 250° C. (482° F.) to about 350° C. (662° F.), and under an atmosphere of hydrogen gas or admixture of hydrogen and another gas, or gases within which the hydrogen partial pressure ranges from about 0 psig (one atmosphere or 14.7 psia) to about 1000 psig, preferably from about 100 psig to about 600 psig. Some positive pressure of hydrogen is necessary in conducting the reaction, though the hydrogen pressure can thus be at atmospheric pressure, or less. In some instances it can be advantageous to add non-oxiding gases other than hydrogen to the treat gas to modify, improve, or control the reaction, e.g., nitrogen, ammonia, methane, carbon monoxide, carbon dioxide, or the like. The combination of temperature and hydrogen partial pressure are preferably such that a part of the feed, at reaction conditions, is in vapor phase. Temperatures above about 430° C. (806° F.) generally should not be employed because excessive temperature causes cracking of the feed, and carbon fouling of the catalyst. At temperatures below about 225° C. (437° F.), on the other hand, the temperature is generally inadequate to reduce color, or reduce the residual nitrogen concentration. Total pressures are not critical, but generally range from about 0 psig to about 1200 psig, preferably from about 100 psig to about 750 psig. Treat gas rates, based on hydrogen, range from about 500 to about 10,000 SCF/B, preferably from about 1000 to about 5000 SCF/B. Space velocities range generally from about 0.05 LHSV to about 20 LHSV, preferably from about 0.2 LHSV to about 10 LHSV.

The alkali or alkaline-earth metal promoted iron catalyst required for the practice of this invention can be supported or unsupported, but in either instance the catalytic surface is one which is constituted essentially of metallic, or elemental iron (Fe°) crystallites about which the alkali or alkaline-earth metals are dispersed, often as a monolayer of an alkaline oxide or alkaline-earth metal oxide. The catalyst is unsulfided, and can function in the presence of sulfur only when a sufficient portion of the catalytic surface of the catalyst is substantially metallic, or elemental iron (Fe°). The formation of sufficiently high concentrations of sulfur at the catalyst surface tends to produce catalyst deactivation via the formation of iron sulfide upon the catalyst surface as a consequence of which the use of feeds which contain high concentrations of sulfur or sulfur compounds should be avoided. High concentration of feed sulfur will soon deactivate the catalyst by converting a major portion of the metallic, or elemental iron surface of the catalyst to iron sulfide.

Elemental iron, modified with one or more alkali or alkaline-earth metals, or compounds thereof, is present in the catalyst sufficient to reduce on contact with a feed at reaction conditions the color of the feed, and also the residual nitrogen without significant cracking of most of the hydrocarbon feed components. The catalyst may be bulk (unsupported) iron, or iron dispersed upon a support. The bulk iron catalyst is preferred and it may be employed as essentially metallic iron in bulk, promoted or modified with alkali or alkaline-earth metals, or metal oxides such as sodium, potassium, cesium, magnesium, calcium, barium, or the like. The active iron catalyst, when a bulk iron catalyst, is preferably one which contains at least 50 percent elemental iron, more preferably from about 70 percent to about 98 percent elemental iron, based on the weight of the catalyst. The iron catalyst, when a catalyst wherein the iron is distributed or dispersed upon a support, contains at least about 0.1 percent iron (measured as elemental iron), preferably from about 0.1 percent to about 50 percent iron, and more preferably from about 5 percent to about 25 percent iron, based on the total weight of the catalyst, and the supported metallic component, exclusive of the support component, or components, contains at least 50 percent iron (measured as elemental iron), and preferably from about 70 percent to about 98 percent iron.

A bulk fused iron catalyst is preferred. The fused iron is one fused by heating and melting the iron, thus fusing the iron with an alkali or alkaline-earth metal, or metals, or with an alkali or alkaline-earth metal compound, or compounds, which are generally present in concentrations ranging from about 0.01 percent to about 10 percent, preferably from about 0.2 percent to about 4 percent, based on the total weight of catalyst. Sodium, potassium, cesium, magnesium, calcium, and barium are the preferred alkali or alkaline-earth metals. Aluminum, principally as an oxide ($Al_2O_3$), or compound thereof is also a preferred promoter, or modifier of the fused iron, and it is preferably contained in the catalyst in concentration ranging from about 0.01 percent to about 20 percent, preferably from about 0.5 percent to about 5 percent, calculated as aluminum oxide based on the weight of the catalyst. Other metals may also be used as promoters and/or modifiers, such metals including rhenium, nickel, cobalt, palladium, platinum, and copper. Such metals may be added to the catalyst alone or admixed one metal with another, or with other metals.

The iron based catalyst, as suggested, may also be supported; preferably upon an inorganic oxide support. Supports include, but are not limited to, the oxides of aluminum, silicon, boron, phosphorous, titanium, zirconium, calcium, magnesium, barium, and mixtures of these and other components. Other supports may include clays, such as bentonite, zeolites, and other alumino-silicate materials, e.g., montmorillionite. Additional supports may be selected from the group of refractory carbides and nitrides of the transition metals of Groups IVB, VB, VIB, VIIB, and Group VIII iron group metals. Alumina, magnesia, and mixtures of alumina and magnesia are preferred supports. The iron based catalysts are prepared by methods which include precipitation, coprecipitation, impregnation, vapor deposition, and the formation of metal complexes (i.e., metal carbonyl, etc.) and the like. The impregnation of a porous inorganic oxide support, such as alumina, with a solution of an iron salt with subsequent drying, calcination and reduction of the supported iron catalyst by contact and treatment of the catalyst with hydrogen or hydrogen and ammonia, or ammonia in admixture with another reducing gas, or gases, has been found to provide a highly active catalyst. Impregnation of the support with iron, or iron and other metal promoters or modifiers, by the incipient wetness technique, or technique wherein the iron is contained in solution in measured amount and the entire solution absorbed into the support, subsequently dried, calcined, and activated is preferred. The supported iron catalyst is promoted or modified with alkali or alkaline-earth metals, or oxides of such metals as sodium, potassium, cesium, magnesium, calcium, barium, or the like. The alkali or alkaline-earth metal, or metals, are generally employed in concentrations ranging from about 0.01 percent to about 10 percent, preferably from about 0.2 percent to about 4 percent, based on the total weight of metal, exclusive of the weight of the support. Sodium, potassium, cesium, magnesium, calcium, and barium are the preferred alkali or alkaline-earth metals. Aluminum, principally as an oxide, or compound thereof, is also a preferred promoter, or modifier, and it is preferably employed in the catalyst in concentration ranging from about 0.01 percent to about 20 percent, preferably from about 0.5 percent to about 5 percent, calculated as aluminum oxide ($Al_2O_3$), based on the total weight of metal, exclusive of the weight of the support. Rhenium, nickel, cobalt, palladium, platinum, and copper can also be added to the catalyst as promoters or modifiers, these metals generally being added in concentrations ranging from about 0.01 percent to about 10 percent, preferably in concentration ranging from about 0.5 percent to about 2.5 percent, based on the weight of the supported component, exclusive of the weight of the support. After impregnation of the support, the metal impregnated support is dried generally at temperatures ranging from about 65° C. (149° F.) to about 280° C. (536° F.), preferably from about 80° C. (176° F.) to about 110° C. (230°

F.), in circulating air, vacuum or microwave oven. The calcination is suitably conducted at temperatures ranging from about 300° C. (572° F.) to about 650° C. (1202° F.), preferably from about 450° C. (842° F.) to about 550° C. (1022° F.).

The iron catalysts can be reduced, activated, or reactivated by contact with hydrogen, by sequential contact with hydrogen and ammonia, or reduced and activated by contact with an admixture of ammonia and hydrogen or by contact with an admixture of ammonia and another reducing gas or gases. The reducing gas and ammonia can be generated in situ or ex situ. The catalysts are more effectively activated if activated by contact with a stream of flowing hydrogen, or by contact with a stream characterized as an admixture of hydrogen and ammonia, or admixture of ammonia and another reducing gas, or gases. In addition, other pretreatment conditions may be used in combination with reduction in order to modify and/or enhance the catalyst. Treatment with a hydrogen rich blend with some carbon containing gas, e.g., carbon monoxide or carbon dioxide, can be used to introduce carbon to the catalyst.

The catalyst is reactivated, after deactivation, by contact with hydrogen, or by contact with ammonia in admixture with hydrogen, or ammonia in admixture with another reducing gas, or gases. Similarly, the activity-maintenance of the catalyst can sometimes be improved during an operating run by introducing ammonia, or ammonia in admixture with another gas, or gases, with the nitrogen-containing feed. In general, the ammonia is employed in admixture with another gas, or gases, in concentration ranging from about 0.01 percent to about 20 percent, preferably from about 0.2 percent to about 10 percent, based on the volume of the gas.

The catalyst is activated, pretreated, or reactivated by contact with the gas, or gaseous admixture, at temperatures ranging from about 300° C. (572° F.) to about 600° C. (1112° F.), preferably from about 400° C. (752° F.) to about 500° C. (932° F.). Suitably pressures range from about 0 psig to about 1500 psig, preferably from about 0 psig to about 1000 psig. Hydrogen partial pressures generally range from about 0 psig to about 1000 psig, preferably from about 100 psig to about 600 psig. Space velocities generally range from about 100 GHSV to about 10,000 GHSV, preferably from about 1000 GHSV to about 5000 GHSV.

The invention will be more fully understood by reference to the following demonstrations and examples which present comparative data obtained from runs illustrating its more salient features. All parts are given in terms of weight except as otherwise specified.

A commercial Katalco 35-4 fused iron ammonia synthesis catalyst was employed in conducting the demonstrations and examples described hereafter wherein distillate feedstocks were treated to remove color bodies. The Katalco 35-4 catalyst on an as received basis is constituted of iron oxides modified by controlled amounts of alumina, calcia, potash, silica, and trace impurities. When reduced, the Katalco 35-4 catalyst becomes a highly active stable ammonia synthesis catalyst. Some chemical and physical characteristics of the catalyst on an as received basis are given in Table I, as follows:

TABLE I

Chemical Composition and Physical Characteristics of Katalco 35-4 Fused Iron Catalyst (as Received)

| | |
|---|---|
| I. Chemical Composition, Wt. % | |
| FeO | 24.5 |
| $Fe_2O_3$ | 69.1 |
| Free Fe | Nil |
| Total Fe Oxides | 93.6 |
| $Al_2O_3$ | 2.5 |
| $K_2O$ | 0.8 |
| CaO | 2.0 |
| $SiO_2$ | 0.4 |
| P | Trace |
| S as $SO_3$ | Trace |
| Chloride | <10 ppm |
| $Fe_3^{2+}/Fe_3^{3+}$ | 0.41 |
| Other minor impurities | Trace V and Ti |
| II. Physical Characteristics | |
| Bulk Density | |
| 165 lb/cu ft., oxidized form | |
| 120 lb/cu ft., reduced form | |
| Particle Size | |
| 50–150 mesh or 14–35 mesh (Tyler) | |

EXAMPLE 1

In a first series of runs a light cat cycle oil (LCCO) feedstock, designated "A-1," which contained 493 ppm nitrogen and 1.55 wt. % sulfur, was hydrofined over a typical CoMo hydrotreating catalyst at varying hydrofining conditions as described in Table II. A first run was made by treating the A-1 feed at 1200 psia hydrogen pressure and 343° C. (649° F.) to give a clear, pale yellow product designated "A-2." In a second run, essentially the same operating conditions were employed except that the hydrogen partial pressure was reduced to 450 psia to give a product designated "A-3." The color of product A-3 was worse than A-2, as indicated by the Tag Robinson color and U.V. absorptivity. Visual observation also showed that the color of the product was worse, the product from this run being clear, but of a yellow-orange color. In a third run the hydrogen pressure was decreased from 1200 psia to 450 psia and the operating temperature was increased from 343° C. (649° F.) to 371° C. (700° F.) which caused the color to change from a clear yellow orange to a "murky", brownish-red in the product designated "A-4."

TABLE II

Color-body Production in LCCO During Hydrofining

| Product Designation | A-2 | A-3 | A-4 |
|---|---|---|---|
| Conditions | | | |
| Temperature, °C. (°F.) | 343 (649) | 343 (649) | 371 (700) |
| $H_2$ pressure, psia | 1200 | 450 | 450 |
| LHSV | 0.3 | 0.25 | 0.25 |
| Qualitative Color Assessment | excellent | marginal | poor |
| Visual Color Description | clear, pale yellow | clear, yellow-orange | murky, dark red-brown |
| Tag Robinson Color # | 18½ | 9½ | 3¾ |
| Absorptivity at 470 nm (L/g-cm) × 1000 | 0.20 | 2.6 | 9.4 |

UV/visible light absorption tests, as shown by Table II, provide some quantitative measurement of the color-bodies present in the samples. The absorptivity of the sample at wavelengths peculiar to the species present is directly proportional to the concentration of the species producing the color. Sample A-4, as shown by the data, exhibited over three times the absorptivity of the A-3 sample at a wavelength of 470 nm which is the characteristic wavelength of the red-brown color. It is interesting to note that the LCCO product hydrofined at high pressure, 1200 psia $H_2$, had excellent color as evidenced by the high Robinson color number and low absorptivity. These runs and results clearly illustrate the problem associated with color-body formation, particularly at low-to moderate pressures typical of the vast majority of existing commercial hydrofining units.

EXAMPLE 2

For Example 2, a dark reddish product was prepared by hydrofining a light cat cycle oil at moderate conditions [343° C. (650° F.), 325 psig, LHSV=0.25, 4000 SCF/B TGR] over a $CoMo/Al_2O_3$ catalyst typically used in commercial operations. This product, designated as "A-5," was analyzed by UV/visible light and found to have an absorptivity of 2.01×1000 (L/g-cm) at 470 nanometers.

In treating product A-5 over the iron catalyst for color improvement, a ½" I.D. stainless steel tubular reactor was employed, the feed and hydrogen having been cocurrently introduced into the top of the reactor and passed downwardly over a fixed bed of Katalco 35-4 fused iron catalyst ground and screened to 50–150 mesh size centered within the reactor. In introducing the hydrofined feed, a small positive displacement pump was employed. The feed was pumped through ⅛" tubing to a tee, located just prior to entering the top of the reactor, where it was mixed with hydrogen before introduction to the reactor. An infrared furnace was employed to heat the reactor, and the temperature of the reaction was measured by a thermocouple located within the catalyst bed, and controlled by the use of an automatic temperature controller in operative association with the infrared furnace. The product was passed through a bottom adapter and collected in a vented, cooled flash located near the bottom of the reactor. A back pressure regulator was employed to maintain the desired pressure in the reactor.

The treatment of A-5 over the fused iron catalyst at mild conditions of 100 psig total pressure, 350° C. (662° F.), 6000 SCF/B, and 0.65 LHSV produced a clear golden yellow product ostensibly free of the bothersome brown-red color-bodies. Analysis by the UV/visible absorbance test confirmed that color-body content was indeed low as evidenced by an absorptivity of 0.051×1000 (L/g-cm) at 470 nanometers. This amounts to a 97% reduction in 470 nm color-body content at the conditions given. Additionally, the level of residual nitrogen was drastically reduced. A summary of the test results is given in Table III.

TABLE III

Results From Treatment of A-5 Over Fused Iron Catalyst

| Sample ID | Before Treatment A-5 | After Treatment Product Composite |
|---|---|---|
| Qualititative Color Assessment | marginal | excellent |
| Visual Color Description | dark reddish-orange | clear, pale yellow with green tint |
| Absorptivity at 470 nm (L/g-cm) × 1000 | 2.01 | 0.051 |
| Nitrogen level, ppm | 169 | 5 |

EXAMPLE 3

In a subsequent test, the color-removal properties of fused iron were further confirmed. Here, a moderately hydrotreated LCCO product was again prepared, [371° C. (700° F.), 500 psig, LHSV=1.0, 4000 SCF/B TGR] this time with even worse color than that exhibited by the A-5 sample described above. This sample, referred to as "A-6", was a murky, brown-red color with an absorbance of 2.27×1000 (L/(g-cm) at 470 nm. This material was passed over another bed of activated fused iron catalyst (as in the previous example) at two sets of conditions as shown in Table IV. The product designated "A-6-1" described in Table IV was collected after 20 hours of on-oil operation at 350° C. (662° F.), 100 psig, 0.65 LHSV and 6000 SCF/B. Following the collection of this sample, the operating conditions were then changed to 350° C. (662° F.), 100 psig, 0.8 LHSV, and 3000 SCF/B. Approximately 30 hours later, after a total time on oil of 50.7 hours, the product designated "A-6-2" was collected.

As shown in Table IV, operation at both sets of conditions produced yellow-green products having low absorptivities at 470 nm. Absorptivities of A-6-1 and A-6-2 were 0.053 and 0.22×1000 (L/g-cm), respectively. Thus, the fused iron catalyst was extremely effective at improving the color of hydrofined products at both sets of mild operating conditions. Additionally, the levels of nitrogen in the products were significantly reduced.

TABLE IV

Results From Treatment of A-6 Over Fused Iron Catalyst

| Sample ID | A-6 Before Treatment Over Fused Iron | A-6-1 After Treatment Over Fused Iron | A-6-2 After Treatment Over Fused Iron |
|---|---|---|---|
| Conditions | | | |
| Hours on oil | — | 20.0 | 50.7 |
| Temperature, °C. (°F.) | — | 350 (662) | 350 (662) |
| Total pressure, psig | — | 100 | 100 |
| LHSV | — | 0.65 | 0.8 |
| TGR, KSCF/B | — | 6 | 3 |
| Qualitative Color Assessment | poor | excellent | excellent |
| Visual Color Description | murky, reddish-Orange | clear, pale yellow with green tint | |
| Absorptivity at 470 nm, (L/g-cm) × 1000 | 2.27 | 0.053 | 0.22 |
| Nitrogen level, ppm | 146 | 4 | 44 |

In the past, other materials have been used to remove trace amounts of color-bodies in mid-distillate products. Some of these are activated carbon, clay/silica, and inert or catalytically active balls. An additional important property of the fused iron catalyst, however, makes it far superior to all of these materials. The fused iron catalyst thus has an extremely high activity for nitrogen removal. In these studies, fused iron removed at least 70 percent of the nitrogen in the A-5 and A-6 materials, and removed over 90 percent in a majority of the samples collected. Computations of hydrodenitrogenation (HDN) activities (from HDN results given in Table IV) also show that the HDN constant of the iron catalyst at equivalent conditions is an order-of-magnitude greater than the activity of the widely-used CoMo catalyst; this taking into account, and recognizing, that both catalysts perform optimally at widely differing sets of conditions. Traditional hydrotreating catalysts thus perform best at higher pressures, while fused iron catalysts appear to perform best at lower pressures.

It is apparent that various modifications and changes can be made without departing the spirit and scope of the invention.

Having described the invention, what is claimed is:

1. In a hydrofining process wherein hydrogen, and a feed characterized as an admixture of hydrocarbons which contains organic sulfur, or organic nitrogen, or both, having a high end point boiling below about 370° C. and a low end boiling point above about 150° C., and contains up to about 2 weight percent sulfur, and up to about 500 ppm nitrogen, is contacted over a hydrofining catalyst and hydrofined at hydrofining conditions inclusive of an initial temperature ranging between about 275° C. and about 450° C., and the temperature gradually raised during the operation to maintain catalyst activity, deterioration of said feed occurring as manifested by increased discoloration of the reaction product mixture, and sulfur as hydrogen sulfide, or nitrogen as ammonia, or both, are separated from the hydrofined reaction product, the improvement wherein said hydrofined product from which sulfur, or nitrogen, or both, have been removed is contacted as a feed, in the presence of hydrogen, over a catalyst comprised of elemental iron and one or more alkali or alkaline-earth metals components at a temperature ranging from about 225° C. to about 430° C. and hydrogen partial pressure ranging from about 0 psig to about 1000 psig sufficient to reduce the discoloration of said feed, and increase the length of the operating cycle.

2. The process of claim 1 wherein the hydrofining catalyst with which the feed and hydrogen are contacted at hydrofining conditions is characterized as a composite of a porous refractory inorganic oxide and a Group VI-B or Group VIII metal, or both.

3. The process of claim 2 wherein the Group VI-B metal of the catalyst is molybdenum or tungsten, and the Group VIII metal is cobalt or nickel.

4. The process of claim 3 wherein the metals of the catalyst are cobalt and molybdenum, or nickel and molybdenum.

5. The process of claim 2 wherein the porous refractory inorganic oxide portion of the catalyst composite is alumina.

6. The process of claim 1 wherein the iron catalyst with which the feed and hydrogen are contacted at reaction conditions is a bulk iron catalyst which contains at least 50 percent elemental iron.

7. The process of claim 6 wherein the catalyst is a fused iron catalyst.

8. The process of claim 1 wherein the iron catalyst with which the feed and hydrogen are contacted at reaction conditions is a bulk iron catalyst which contains at least 70 percent to about 98 percent elemental iron.

9. The process of claim 1 wherein the iron catalyst with which the hydrofined product is contacted at reaction conditions contains said alkali or alkaline-earth metals in concentrations ranging from about 0.01 percent to about 10 percent.

10. The process of claim 9 wherein the catalyst also contains aluminum in concentration ranging from about 0.01 percent to about 20 percent.

11. The process of claim 1 wherein the iron catalyst with which the hydrofined product is contacted at reaction conditions is a supported iron catalyst, and contains at least about 0.1 percent iron, based on the weight of the catalyst, and the supported metallic component, exclusive of the support component, or components, contains at least 50 percent iron.

12. The process of claim 11 wherein the supported iron catalyst, with which the hydrofined product is contacted with at reaction conditions, contains one or more alkali or alkaline-earth metals in concentration ranging from about 0.01 percent to about 10 percent.

13. The process of claim 11 wherein the catalyst also contains aluminum in concentration ranging from about 0.01 percent to about 20 percent.

14. The process of claim 1 wherein the iron catalyst with which the hydrofined product is contacted at reaction conditions contains said alkali or alkaline-earth metals in concentrations ranging from about 0.2 percent to about 4 percent.

15. The process of claim 14 wherein the catalyst also contains aluminum in concentration ranging from about 0.5 percent to about 5 percent.

16. The process of claim 1 wherein the iron catalyst with which the hydrofined product is contacted at reaction conditions is a supported iron catalyst, and contains from about 0.1 percent to about 50 percent iron, based on the weight of the catalyst, and the supported metallic component, exclusive of the supported component, or components, contains at least 50 percent iron.

17. The process of claim 16 wherein the supported iron catalyst contains from about 5 percent to about 25 percent iron, based on the total weight of the catalyst, and the supported metallic component, exclusive of the supported component, or components, contains from about 70 percent to about 98 percent iron.

18. The process of claim 17 wherein the catalyst contains one or more alkali or alkaline-earth metals in concentration ranging from about 0.01 percent to about 10 percent, and also aluminum in concentration ranging from about 0.01 percent to about 20 percent.

* * * * *